US010703100B2

(12) United States Patent
Morisue et al.

(10) Patent No.: US 10,703,100 B2
(45) Date of Patent: Jul. 7, 2020

(54) LIQUID EJECTION HEAD AND METHOD OF MANUFACTURING THE SAME

(71) Applicant: CANON KABUSHIKI KAISHA, Tokyo (JP)

(72) Inventors: Masafumi Morisue, Tokyo (JP); Yoshiyuki Nakagawa, Kawasaki (JP); Kazuhiro Yamada, Yokohama (JP); Takuro Yamazaki, Inagi (JP); Ryo Kasai, Tokyo (JP); Tomoko Kudo, Kawasaki (JP); Takashi Sugawara, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/135,111

(22) Filed: Sep. 19, 2018

(65) Prior Publication Data

US 2019/0092007 A1 Mar. 28, 2019

(30) Foreign Application Priority Data

Sep. 27, 2017 (JP) ..... 2017-186667

(51) Int. Cl.
*B41J 2/14* (2006.01)
*B41J 2/16* (2006.01)

(52) U.S. Cl.
CPC ..... *B41J 2/14* (2013.01); *B41J 2/14016* (2013.01); *B41J 2/162* (2013.01); *B41J 2/1603* (2013.01); *B41J 2/1623* (2013.01); *B41J 2/1628* (2013.01); *B41J 2/1629* (2013.01); *B41J 2/1631* (2013.01); *B41J 2/1639* (2013.01); *B41J 2/1642* (2013.01); *B41J 2/1646* (2013.01); *B41J 2002/14467* (2013.01); *B41J 2002/14491* (2013.01); *B41J 2202/12* (2013.01)

(58) Field of Classification Search
CPC .... B41J 2002/14467; B41J 2002/14491; B41J 2/14; B41J 2/14016; B41J 2/162; B41J 2/1623
See application file for complete search history.

(56) References Cited

U.S. PATENT DOCUMENTS

2007/0285469 A1* 12/2007 Sato ..... B41J 2/1623 347/63
2015/0053950 A1* 2/2015 Suematsu ..... H01B 1/24 257/40

FOREIGN PATENT DOCUMENTS

JP 2007-261170 A 10/2007
WO 2013/130039 A1 9/2013

* cited by examiner

*Primary Examiner* — Jannelle M Lebron
(74) *Attorney, Agent, or Firm* — Venable LLP

(57) ABSTRACT

Provided is a liquid ejection head including: a substrate; an energy-generating element, which is arranged on the substrate, and is used for ejecting a liquid; a flow path forming member, which has an ejection orifice for ejecting the liquid, and is configured to form a flow path of the liquid between the flow path forming member and the substrate; an electrode configured to generate a flow of the liquid; and a wiring, which is arranged so as to be brought into contact with the flow path forming member, and is configured to supply electric power to the electrode, in which the flow path forming member contains an organic material, and in which the electrode and the wiring are each formed of a conductive adhesive layer containing at least one of conductive diamond-like carbon or tin-doped indium oxide.

15 Claims, 8 Drawing Sheets

LIQUID EJECTION HEAD AND METHOD OF MANUFACTURING THE SAME

BACKGROUND OF THE INVENTION

Field of the Invention

The present invention relates to a liquid ejection head and a method of manufacturing the liquid ejection head.

Description of the Related Art

In a liquid ejection head configured to eject a liquid, for example, ink, a volatile component in the liquid is evaporated, and the liquid in an ejection orifice is thickened in some cases. In particular, when the viscosity of the liquid increases significantly, the resistance of a fluid increases to cause an ejection failure of the liquid in some cases. As one of the countermeasures against such a liquid thickening phenomenon, there has been known a method involving flowing a fresh liquid, which has not been thickened, into the ejection orifice. As a method of flowing the liquid, there is given, for example, a method using a micro-pump as in alternating current electro-osmosis (ACEO) (International Publication No. WO2013/130039).

Meanwhile, in order to improve adhesiveness between a wiring and a flow path forming member, there has been known a technology of inserting an insulating adhesive layer (volume resistivity: 106 Ωcm or more) made of silicon oxide, silicon nitride, or the like between the wiring and the flow path forming member (for example, Japanese Patent Application Laid-Open No. 2007-261170).

SUMMARY OF THE INVENTION

According to one embodiment of the present invention, there is provided a liquid ejection head including: a substrate; an energy-generating element, which is arranged on the substrate, and is used for ejecting a liquid; a flow path forming member, which has an ejection orifice for ejecting the liquid, and is configured to form a flow path of the liquid between the flow path forming member and the substrate; an electrode configured to generate a flow of the liquid; and a wiring, which is arranged so as to be brought into contact with the flow path forming member, and is configured to supply electric power to the electrode, in which the flow path forming member contains an organic material, and in which the electrode and the wiring are each formed of a conductive adhesive layer containing at least one of conductive diamond-like carbon or tin-doped indium oxide.

According to one embodiment of the present invention, there is provided a method of manufacturing a liquid ejection head, the method including: forming a conductive adhesive layer on a substrate having an energy-generating element to be used for ejecting a liquid arranged thereon; patterning the conductive adhesive layer to form an electrode configured to generate a flow of the liquid and a wiring configured to supply electric power to the electrode; and forming a flow path forming member, which has an ejection orifice for ejecting the liquid and is configured to form a flow path of the liquid between the flow path forming member and the substrate, on the substrate so that the flow path forming member is brought into contact with the wiring, in which the flow path forming member contains an organic material, and in which the conductive adhesive layer contains at least one of conductive diamond-like carbon or tin-doped indium oxide.

According to one embodiment of the present invention, there is provided a method of manufacturing a liquid ejection head, the method including: forming a side wall portion of a flow path forming member configured to form a flow path of a liquid and a mold material of the flow path on a substrate having an energy-generating element to be used for ejecting the liquid arranged thereon; forming a conductive adhesive layer on the side wall portion and the mold material; patterning the conductive adhesive layer to form an electrode configured to generate a flow of the liquid and a wiring configured to supply electric power to the electrode; forming a ceiling portion of the flow path forming member having an ejection orifice for ejecting the liquid on the side wall portion, the mold material, the electrode, and the wiring; and removing the mold material to form the flow path, in which the side wall portion of the flow path forming member contains an organic material, and in which the conductive adhesive layer contains at least one of conductive diamond-like carbon or tin-doped indium oxide.

Further features of the present invention will become apparent from the following description of exemplary embodiments with reference to the attached drawings.

DESCRIPTION OF THE EMBODIMENTS

Figure 1:
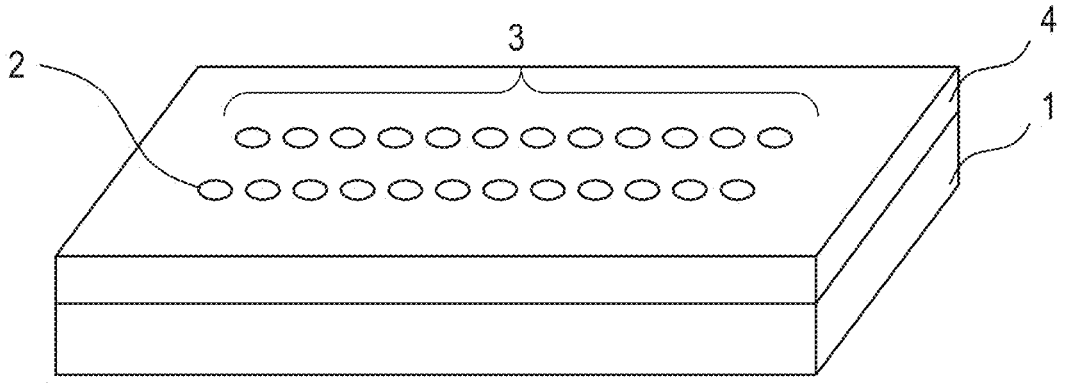
FIG. 1 is a perspective view for illustrating one example of an ink jet recording head according to an embodiment of the present invention.

Preferred embodiments of the present invention will now be described in detail in accordance with the accompanying drawings.

In International Publication No. WO2013/130039, an electrode configured to generate a flow of a liquid is arranged on a substrate. In this configuration, wiring configured to supply electric power to the electrode is required. The electrode and a terminal for external connection are electrically connected to each other by drawing around the wiring on the substrate. However, when a flow path forming member, which has an ejection orifice of a liquid and is configured to form a flow path of the liquid, is formed on the substrate through use of an organic material, for example, a resin, there is a problem in that the adhesiveness between the wiring and the flow path forming member is low. In general, the wiring is made of a metal material. Therefore, when the wiring is exposed to a liquid, for example, ink for a long time period, peeling may occur at an interface between the wiring and the flow path forming member.

Meanwhile, in the case of a method described in Japanese Patent Application Laid-Open No. 2007-261170, the insulating adhesive layer is formed also on an electrode when the insulating adhesive layer is formed, and hence it is required to remove the insulating adhesive layer on the electrode by dry etching or other methods. This is because, in order to cause alternating current electro-osmosis, it is required to increase a charge accumulation amount to an electric double layer capacitor. Thus, in this technology, the number of manufacturing steps is increased, and the surface of the electrode is damaged by etching, with the result that the yield is decreased. Meanwhile, when the insulating adhesive layer on the electrode is not removed, the conductivity of the electrode is decreased.

An object of the present invention is to provide a liquid ejection head in which the conductivity of an electrode is high, and the adhesiveness between a wiring and a flow path forming member is high. Another object of the present invention is to provide a method of manufacturing a liquid ejection head capable of reducing the number of manufacturing steps and improving the adhesiveness between the wiring and the flow path forming member without damaging the surface of the electrode.

Liquid Ejection Head

A liquid ejection head according to the present invention includes a substrate, an energy-generating element, a flow path forming member, an electrode, and a wiring. The energy-generating element is arranged on the substrate and is used for ejecting a liquid. The flow path forming member has ejection orifices for ejecting the liquid and is configured to form a flow path of the liquid between the flow path forming member and the substrate. The electrode is configured to generate a flow of the liquid. The wiring is arranged so as to be brought into contact with the flow path forming member and configured to supply electric power to the electrode. In this case, the flow path forming member contains an organic material. Further, the electrode and the wiring are each formed of a conductive adhesive layer containing at least one of conductive diamond-like carbon (hereinafter sometimes referred to as "conductive DLC") or tin-doped indium oxide (hereinafter sometimes referred to as "ITO").

In the liquid ejection head according to the present invention, the electrode and the wiring are each formed of the conductive adhesive layer containing conductive DLC and/or ITO. In this case, conductive DLC and ITO have high conductivity and exhibit high adhesiveness with respect to the organic material. Therefore, the wiring in the liquid ejection head according to the present invention exhibits high adhesiveness with respect to the flow path forming member containing the organic material. Further, the electrode in the liquid ejection head according to the present invention has high conductivity.

Now, the liquid ejection head according to an embodiment of the present invention is described with reference to the drawings. In each of the embodiments described below, a specific configuration of an ink jet recording head configured to eject ink as a liquid according to one embodiment of the present invention is described, but the present invention is not limited thereto. The liquid ejection head according to the present invention is applicable to apparatus such as a printer, a copying machine, a facsimile apparatus including a communication system, and a word processor including a printer portion, and further to an industrial recording apparatus combined with various processing devices in a composite manner. For example, the liquid ejection head can be used also for biochip manufacturing and electronic circuit printing. Further, the embodiments described below are appropriate specific examples of the present invention, and hence technically preferred various limitations are provided. However, those embodiments are not limited to those described herein or other specific methods as long as the embodiments follow the concept of the present invention.

FIG. 1 is a perspective view for illustrating one example of an ink jet recording head according to an embodiment of the present invention. A flow path forming member 4 is joined to a substrate 1, and a plurality of ejection orifices 2 are arranged in the flow path forming member 4. The ejection orifices 2 are arrayed in a plural number to form an ejection orifice array 3. The flow path forming member 4 contains an organic material, for example, an epoxy resin from the viewpoint of improving a degree of freedom in dimension for formation of the flow path forming member 4.

Figure 2A:
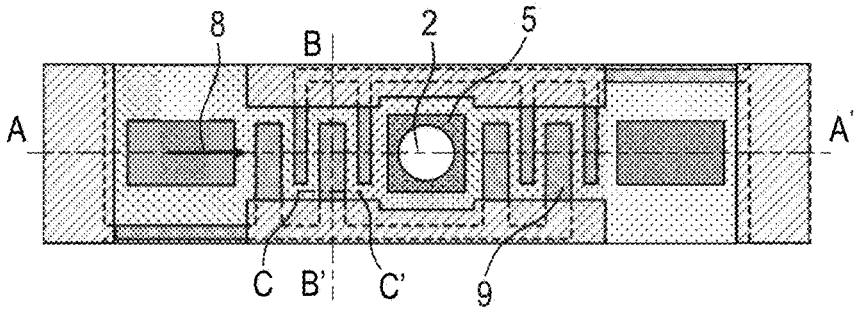
FIG. 2A is a schematic plan view for illustrating one example of the ink jet recording head according to the embodiment of the present invention.
Figure 2B:
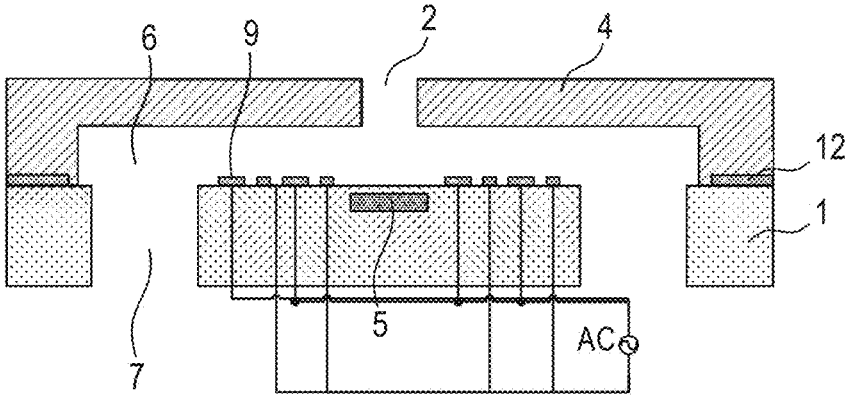
FIG. 2B is a schematic sectional view taken along a line A-A' of FIG. 2A.
Figure 2C:
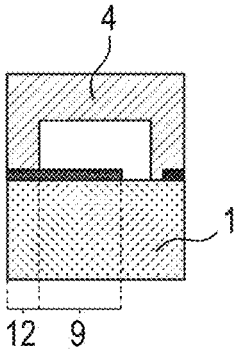
FIG. 2C is a schematic sectional view taken along a line B-B' of FIG. 2A.
Figure 2D:
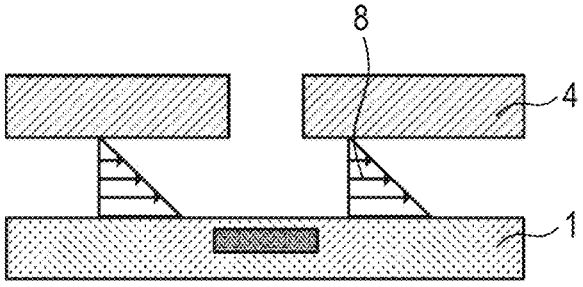
FIG. 2D is a schematic view for illustrating a flow speed distribution of ink in FIG. 2B.

FIG. 2A is a schematic plan view for illustrating one example of the ink jet recording head according to the embodiment of the present invention. FIG. 2B is a schematic sectional view taken along a line A-A' of FIG. 2A. FIG. 2C is a schematic sectional view taken along a line B-B' of FIG. 2A. FIG. 2D is a schematic view for illustrating a flow speed distribution of ink in FIG. 2B.

As illustrated in FIG. 2A and FIG. 2B, the substrate 1 includes an energy-generating element 5 configured to generate energy for ejecting ink. Further, the substrate 1 includes a supply port 7 of ink penetrating through the substrate 1 from one surface to another surface. The flow path forming member 4, which has the ejection orifice 2 formed at a position opposed to the energy-generating element 5 and configured to eject ink and which is configured to form a flow path 6 of the ink between the flow path forming member 4 and the substrate 1, is formed on the substrate 1. Ink supplied from the supply port 7 into the flow path 6 is supplied with energy by the energy-generating element 5 and ejected from the ejection orifice 2 to an ink receiving medium, for example, a recording medium. A region between the energy-generating element 5 and the ejection orifice 2 serves as a pressure chamber. The pressure chamber is a chamber which is connected to the flow path 6 and accommodates the energy-generating element 5.

A plurality of electrodes 9 that are brought into contact with ink are arranged on the substrate 1. The electrodes 9 are configured to generate a flow of ink in a direction of an arrow 8 by alternating current electro-osmosis. The electrodes 9 are electrically connected to terminals for external connection through a wiring 12 which is drawn around on the surface of the substrate 1 and is not brought into contact with ink. The electrodes 9 have two systems that are respectively connected to positive terminals and negative terminals of an AC power source. When ink is caused to flow by alternating current electro-osmosis, as illustrated in FIG. 2D, in a flow speed distribution of ink in the flow path 6, a flow speed is large on the surface of the substrate 1 and gradually approaches 0 with proximity to the flow path forming member 4. By virtue of this flow of ink, fresh ink, which has not been thickened, can be supplied into the ejection orifice 2. Further, ink in the pressure chamber can be circulated between the pressure chamber and the outside by the electrodes 9.

In the ink jet recording head illustrated in FIG. 2A to FIG. 2D, the electrodes 9 and the wiring 12 are each formed of a conductive adhesive layer containing at least one of conductive DLC or ITO. Conductive DLC and ITO have high corrosion resistance and conductivity and have a feature in that, even when being immersed in a liquid, for example, ink for a long time period, the adhesion strength with respect to the flow path forming member 4 containing the organic material is less liable to be decreased. Therefore, the electrodes 9 have high conductivity. Further, the adhesiveness between the wiring 12 and the flow path forming member 4 is high, and hence it is not required to separately form an intermediate layer, for example, an insulating adhesive layer. Further, in the ink jet recording head, the electrodes 9 and the wiring 12 are formed of the same conductive adhesive layer, and hence the electrodes 9 and the wiring 12 can be formed at a time as described later. The "conductivity" of the conductive adhesive layer refers to a volume resistivity of 100 Ωcm or less. Further, in the ink jet recording head illustrated in FIG. 2A to FIG. 2D, the electrodes 9 and the wiring 12 are formed of the same conductive adhesive layer, but may be formed of different conductive adhesive layers. Further, as described later, the electrodes 9 and the wiring 12 may include a layer other than the conductive adhesive layer.

Diamond-like carbon (hereinafter sometimes referred to as "DLC") refers to an amorphous material formed of hydrocarbon and an allotrope of carbon. DLC is varied in characteristics depending on the content of hydrogen and the ratio of contained electron trajectory (sp3 trajectory/sp2 trajectory). A layer made of general DLC is an insulating layer having a volume resistivity of from 106 Ωcm to 1012 Ωcm. However, when DLC is doped with elements such as boron, nitrogen, and nickel, the volume resistivity can be decreased to obtain conductive DLC. That is, conductive DLC can contain at least one kind of an element selected from the group consisting of boron, nitrogen, and nickel. As a method of forming a layer containing conductive DLC, there are given vapor deposition, chemical vapor deposition (CVD), sputtering, ion plating, ionized film deposition, and plasma ion implantation and film forming. The volume resistivity of a layer containing conductive DLC can be controlled by appropriately changing the conditions such as a substrate temperature and a gas flow rate during formation of a layer.

Meanwhile, ITO is a mixture of indium oxide and tin oxide. A layer made of ITO is transparent and has conductivity. Therefore, the film made of ITO is used in a touch panel, a liquid crystal display, and the like. The resistance and transparency of a layer to be obtained can be varied by changing the ratio between indium oxide and tin oxide. As a method of forming a layer containing ITO, physical vapor deposition (PVD) such as sputtering and vapor deposition is generally used. However, methods such as chemical vapor deposition (CVD) and application film forming using a sol-gel liquid can also be used. The volume resistivity of the layer containing ITO can be controlled by appropriately changing the conditions such as a substrate temperature and a gas flow rate during formation of a layer.

Figure 3A:
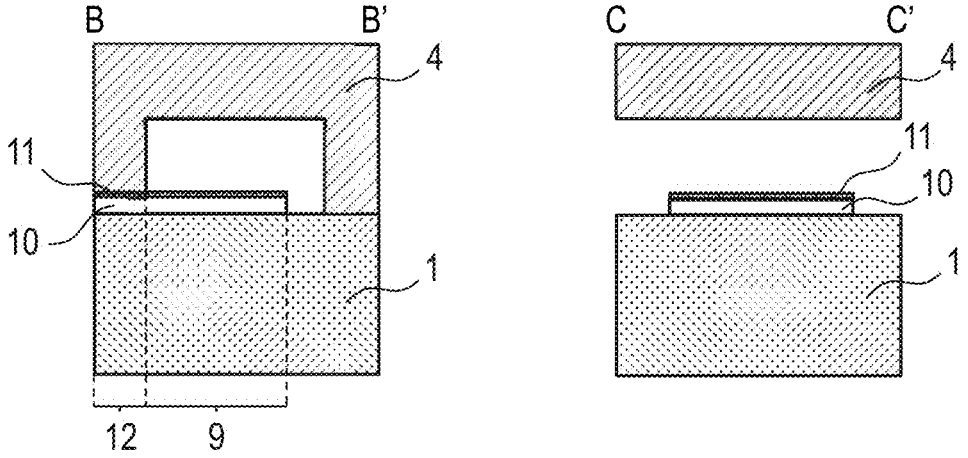
FIG. 3A is a view for illustrating one example of the ink jet recording head according to the embodiment of the present invention, with the left side being a schematic sectional view taken along the line B-B' of FIG. 2A, and the right side being a schematic sectional view taken along a line C-C' of FIG. 2A.
Figure 3B:
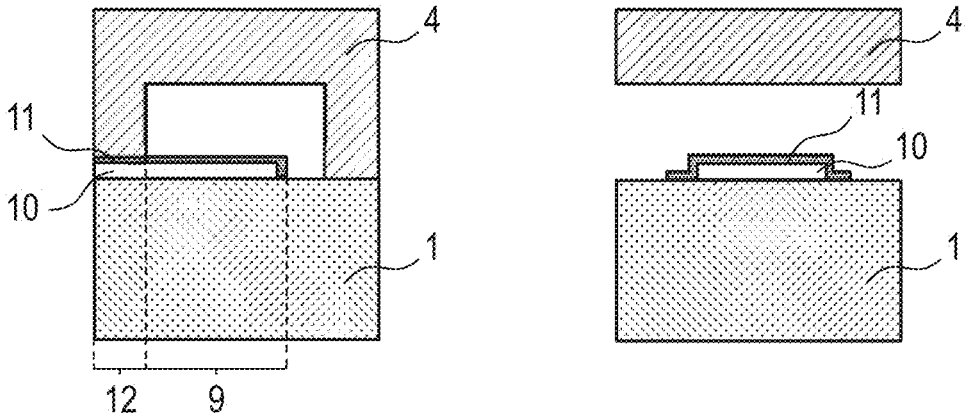
FIG. 3B is a view for illustrating one example of the ink jet recording head according to the embodiment of the present invention, with the left side being a schematic sectional view taken along the line B-B' of FIG. 2A, and the right side being a schematic sectional view taken along the line C-C' of FIG. 2A.
Figure 3C:
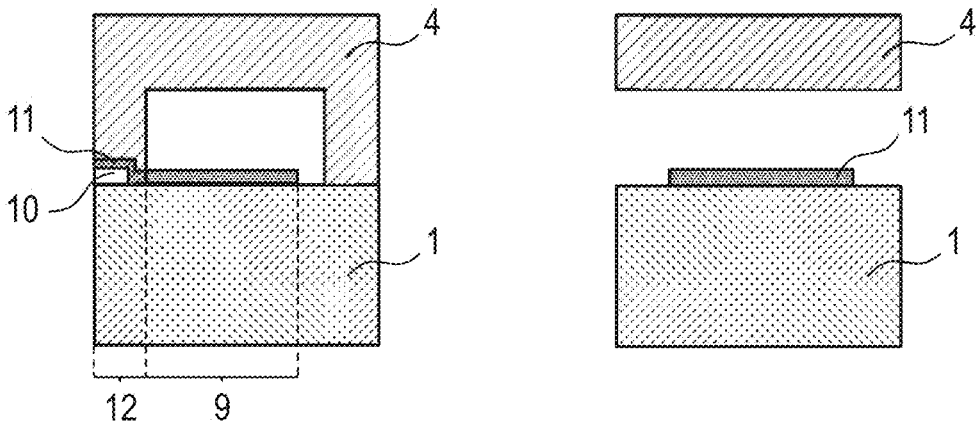
FIG. 3C is a view for illustrating one example of the ink jet recording head according to the embodiment of the present invention, with the left side being a schematic sectional view taken along the line B-B' of FIG. 2A, and the right side being a schematic sectional view taken along the line C-C' of FIG. 2A.

In the ink jet recording head according to this embodiment, at least one of the electrode 9 or the wiring 12 may be formed of a conductive adhesive layer as illustrated in FIG. 2A to FIG. 2C, but further include a low-resistance layer 10 having a volume resistivity lower than that of the conductive adhesive layer. An example in which at least one of the electrode 9 or the wiring 12 further includes the low-resistance layer 10 is illustrated in FIG. 3A to FIG. 3C. FIG. 3A to FIG. 3C each include a schematic sectional view of the ink jet recording head taken along the line B-B' of FIG. 2A and a schematic sectional view thereof taken along a line C-C' of FIG. 2A.

In the configuration illustrated in FIG. 3A, the electrode 9 and the wiring 12 are each formed of a conductive adhesive layer 11 and the low-resistance layer 10 having a volume resistivity lower than that of the conductive adhesive layer 11. The low-resistance layer 10 is formed so as to be brought into contact with the substrate 1, and the conductive adhesive layer 11 is formed so as to be brought into contact with the flow path forming member 4. In this configuration, even when the volume resistivity of the conductive adhesive layer 11 is relatively high, in the electrode 9, a current flows only in a thickness direction of the electrode 9. In this configuration, a sufficient voltage can be applied from the wiring 12 to the electrode 9, and the function of an alternating current electro-osmotic pump can be improved. There is no particular limitation on a material for the low-resistance layer 10 as long as the volume resistivity of the low-resistance layer 10 is lower than that of the conductive adhesive layer. For example, noble metal such as Au, Pt, or Ir, metal such as Al, Cu, Ni, W, Ti, or Ta, or an alloy thereof can be used.

Further, as illustrated in FIG. 3B, the low-resistance layer 10 may be covered with the conductive adhesive layer 11. In this configuration, even when the low-resistance layer 10 has low corrosion resistance, the low-resistance layer 10 is not brought into contact with ink, and hence a degree of freedom in selection of a material for the low-resistance layer 10 is improved. Further, as illustrated in FIG. 3C, only the wiring 12 may further include the low-resistance layer 10. In this configuration, the resistance of the wiring 12 is low. Therefore, even when a large number of the electrodes 9 are branched to be connected to cause a large amount of a current to flow, the function as electric power wiring is improved. Meanwhile, the risk in that the low-resistance layer 10 is subjected to damage, for example, corrosion due to defects such as a coverage failure and pinholes of the conductive adhesive layer 11 is eliminated, and hence reliability is improved. The thickness of the conductive adhesive layer 11 is preferably 1 μm or less, more preferably from 50 nm to 200 nm from the viewpoint of both conductivity and processability.

When the conductive adhesive layer 11 contains conductive DLC, the volume resistivity of the conductive adhesive layer 11 is preferably 10 Ωcm or less. This is because, even in the configuration illustrated in FIG. 3A and FIG. 3B, a lower layer (low-resistance layer 10) can be sufficiently protected, and an appropriate voltage can be applied to the electrode 9. The volume resistivity is more preferably 0.1 Ωcm or less. This is because, even in the configuration illustrated in FIG. 3C, an appropriate voltage can be applied to the electrode 9. Further, the volume resistivity is still more preferably 0.001 Ωcm or less. This is because, even when the electrode 9 and the wiring 12 are each formed of the conductive adhesive layer as illustrated in FIG. 2A and FIG. 2B, an appropriate voltage can be applied to the electrode 9. Meanwhile, when the conductive adhesive layer 11 contains ITO, the volume resistivity of the conductive adhesive layer 11 is preferably 0.001 Ωcm or less. Those volume resistivities are values measured by a method described later.

Figure 4A:
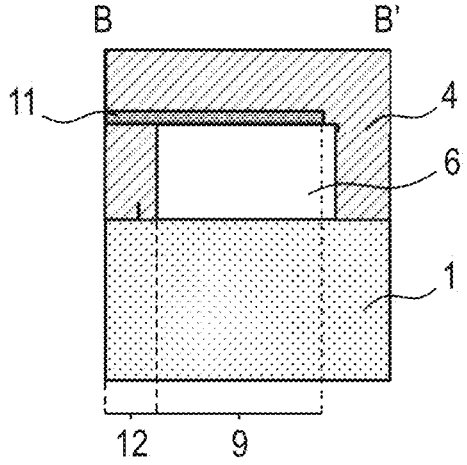
FIG. 4A is a view for illustrating one example of the ink jet recording head according to the embodiment of the present invention, which is a schematic sectional view taken along the line B-B' of FIG. 2A.
Figure 4B:
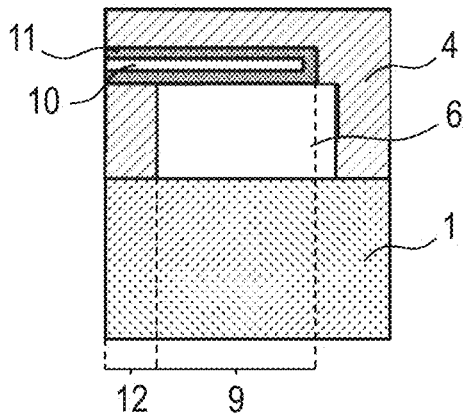
FIG. 4B is a view for illustrating one example of the ink jet recording head according to the embodiment of the present invention, which is a schematic sectional view taken along the line B-B' of FIG. 2A.
Figure 4C:
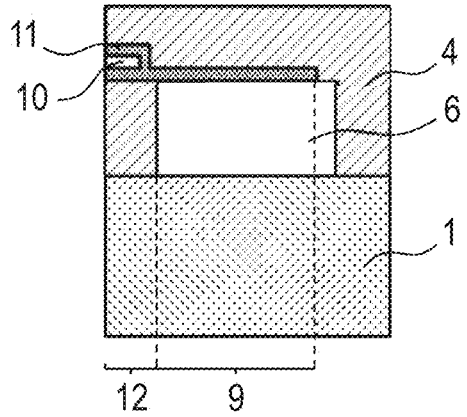
FIG. 4C is a view for illustrating one example of the ink jet recording head according to the embodiment of the present invention, which is a schematic sectional view taken along the line B-B' of FIG. 2A.

In the ink jet recording head according to this embodiment, as illustrated in FIG. 2A, FIG. 2B, and FIG. 3A to FIG. 3C, at least one of the electrode 9 or the wiring 12 may be arranged on the substrate 1, but the electrode 9 may be arranged on a surface of the flow path forming member 4 that is held in contact with the flow path 6. An example in which the electrode 9 is arranged on the surface of the flow path forming member 4 that is held in contact with the flow path 6 is illustrated in FIG. 4A to FIG. 4C. FIG. 4A to FIG. 4C are each a schematic view for illustrating a cross section of the ink jet recording head taken along the line B-B' of FIG. 2A.

In the configuration illustrated in FIG. 4A, the electrode 9 and the wiring 12 are each formed of the conductive adhesive layer 11, and the electrode 9 is opposed to the substrate 1 and arranged on the surface of the flow path forming member 4 that is held in contact with the flow path 6. Further, a part of the wiring 12 is arranged in the flow path forming member 4. That is, a part of the wiring 12 is contained in the flow path forming member 4. Although not shown in FIG. 4A, the wiring 12 is brought into conduction with the substrate 1 side at an appropriate position and connected to terminals for external connection. In this configuration, in spite of the fact that an interface between the wiring 12 and the flow path forming member 4 is present on front and rear surfaces of the wiring 12, the electrode 9 and the wiring 12 can be each formed of only the conductive adhesive layer 11. Further, when ITO is used as a material for the conductive adhesive layer 11, ITO is transparent, and hence the inside of the flow path 6 can be visually observed.

In this case, even when a failure such as clogging in the flow path 6 occurs, inspection and the like can be easily performed.

Further, as illustrated in FIG. 4B, the electrode 9 and the wiring 12 may be each formed of the conductive adhesive layer 11 and the low-resistance layer 10 so that the low-resistance layer 10 is covered with the conductive adhesive layer 11. In this configuration, even when the low-resistance layer 10 has low corrosion resistance, the low-resistance layer 10 is not brought into contact with ink, and hence a degree of freedom in selection of a material for the low-resistance layer 10 is improved. Further, as illustrated in FIG. 4C, only the wiring 12 may be formed of the conductive adhesive layer 11 and the low-resistance layer 10 so that the low-resistance layer 10 is covered with the conductive adhesive layer 11. In this configuration, the resistance of the wiring 12 is low. Therefore, even when a large number of the electrodes 9 are branched to be connected to cause a large amount of a current to flow, the function as electric power wiring is improved. Meanwhile, the risk in that the low-resistance layer 10 is subjected to damage, for example, corrosion due to defects such as a coverage failure and pinholes of the conductive adhesive layer 11 is eliminated, and hence reliability is improved.

Method of Manufacturing Liquid Ejection Head

First Embodiment

A method of manufacturing a liquid ejection head according to a first embodiment of the present invention includes the following steps of: forming a conductive adhesive layer on a substrate having an energy-generating element to be used for ejecting a liquid arranged thereon; patterning the conductive adhesive layer to form an electrode configured to generate a flow of the liquid and a wiring configured to supply electric power to the electrode; and forming a flow path forming member, which has an ejection orifice for ejecting the liquid and is configured to form a flow path of the liquid between the flow path forming member and the substrate, on the substrate so that the flow path forming member is brought into contact with the wiring. In this case, the flow path forming member contains an organic material. Further, the conductive adhesive layer contains at least one of conductive DLC or ITO.

In the method according to the first embodiment, the conductive adhesive layer forming the electrode and the wiring can be formed at a time, and hence the number of manufacturing steps can be reduced. Further, the conductive adhesive layer has high conductivity. Therefore, even when the electrode has a low-resistance layer, and the conductive adhesive layer is formed on the low-resistance layer, it is not required to remove the conductive adhesive layer, and the surface of the electrode is not damaged. Further, the conductive adhesive layer exhibits high adhesiveness with respect to the flow path forming member containing the organic material, and hence high adhesiveness can be ensured at an interface between the wiring and the flow path forming member. It is preferred that the method according to the first embodiment further include, before forming the conductive adhesive layer, forming, on the substrate, a low-resistance layer having a volume resistivity lower than a volume resistivity of the conductive adhesive layer to be a part of the electrode and the wiring because a sufficient voltage can be applied from the wiring to the electrode. Now, one example of the first embodiment is described with reference to FIG. 5A to FIG. 5D.

Figure 5A:
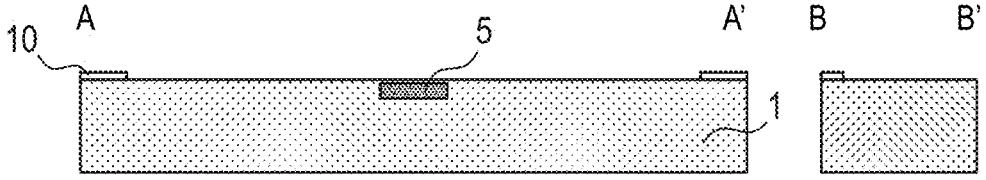
FIG. 5A is a view for illustrating one example of a step of manufacturing the ink jet recording head according to the embodiment of the present invention, with the left side being a schematic sectional view of the ink jet recording head taken along the line A-A' of FIG. 2A, and the right side being a schematic sectional view of the ink jet recording head taken along the line B-B' of FIG. 2A.

FIG. 5A to FIG. 5D are each a view for illustrating a step in cross sections of the ink jet recording head taken along the line A-A' and the line B-B' of FIG. 2A. First, as illustrated in FIG. 5A, the low-resistance layer 10 having a pattern of the wiring 12 is formed on the substrate 1 having the energy-generating elements 5. As a material for the low-resistance layer 10, the above-mentioned materials can be used. The low-resistance layer 10 may be a layer obtained by laminating two or more layers made of different materials. It is only required that the material and layer configuration of the low-resistance layer 10 be appropriately selected in consideration of the volume resistivity, processability, and the like of the low-resistance layer 10. There is no particular limitation on a method of forming the low-resistance layer 10, and for example, vapor deposition or sputtering can be used. The wiring 12 can be patterned through use of a general photolithography technology. It is only required that an optimum method be selected with respect to the selected material, and an unnecessary portion be removed by etching.

Figure 5B:
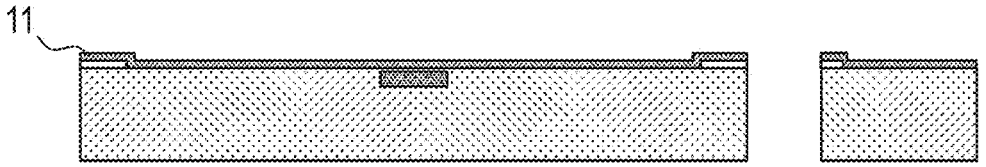
FIG. 5B is a view for illustrating one example of a step of manufacturing the ink jet recording head according to the embodiment of the present invention, with the left side being a schematic sectional view of the ink jet recording head taken along the line A-A' of FIG. 2A, and the right side being a schematic sectional view of the ink jet recording head taken along the line B-B' of FIG. 2A.

Next, as illustrated in FIG. 5B, the conductive adhesive layer 11 is formed on the substrate 1 and the low-resistance layer 10. When the conductive adhesive layer 11 contains conductive DLC, the conductive adhesive layer 11 can be formed by PVD, CVD, or ionized film deposition. When the conductive adhesive layer 11 contains ITO, the conductive adhesive layer 11 can be formed by sputtering or the like.

Figure 5C:
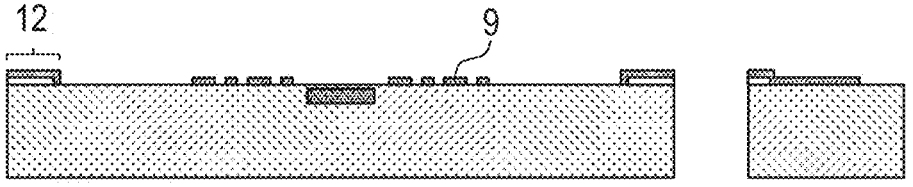
FIG. 5C is a view for illustrating one example of a step of manufacturing the ink jet recording head according to the embodiment of the present invention, with the left side being a schematic sectional view of the ink jet recording head taken along the line A-A' of FIG. 2A, and the right side being a schematic sectional view of the ink jet recording head taken along the line B-B' of FIG. 2A.

Next, as illustrated in FIG. 5C, the conductive adhesive layer 11 is patterned to form the electrodes 9 and the wiring 12. The conductive adhesive layer 11 can be patterned through use of a photolithography technology by forming a resist on regions for forming the electrodes 9 and the wiring 12 and removing the conductive adhesive layer 11 in regions other than the regions for forming the electrodes 9 and the wiring 12 by etching. When the conductive adhesive layer 11 contains conductive DLC, there is given dry etching using oxygen plasma as the etching method. When the conductive adhesive layer 11 contains ITO, there is given wet etching using a solution based on oxalic acid as the etching method.

Figure 5D:
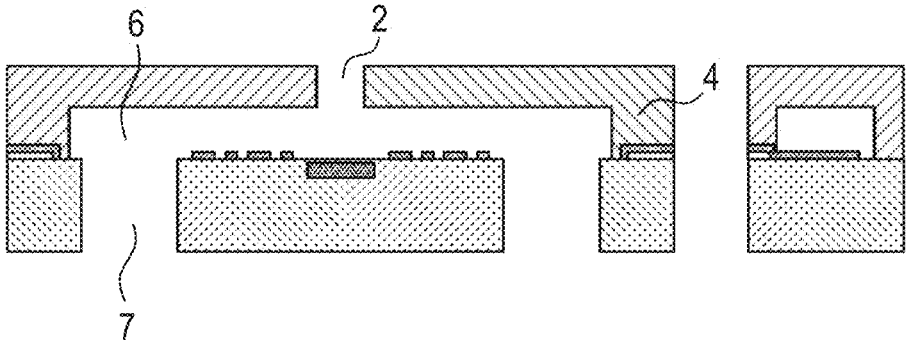
FIG. 5D is a view for illustrating one example of a step of manufacturing the ink jet recording head according to the embodiment of the present invention, with the left side being a schematic sectional view of the ink jet recording head taken along the line A-A' of FIG. 2A, and the right side being a schematic sectional view of the ink jet recording head taken along the line B-B' of FIG. 2A.

Next, as illustrated in FIG. 5D, the supply port 7 is formed in the substrate 1, and the flow path forming member 4 is formed on the substrate 1. The supply port 7 can be formed through use of Bosch dry etching or anisotropic wet etching using an alkaline solution, for example, tetramethylammonium hydroxide (TMAH). As a material for the flow path forming member 4, a negative resist containing an epoxy resin can be used. It is preferred that the flow path forming member 4 be formed through use of a photolithography technology because the energy-generating element 5 and the ejection orifice 2 can positioned with satisfactory accuracy. The flow path forming member 4 to be formed has the ejection orifices 2 and is configured to form the flow path 6 between the flow path forming member 4 and the substrate 1. Further, the flow path forming member 4 is held in contact with the conductive adhesive layer 11 of the wiring 12.

In the method illustrated in FIG. 5A to FIG. 5D, the electrodes 9 and the wiring 12 can be formed at a time through use of the same material, and hence the number of manufacturing steps can be reduced. Further, the adhesiveness between the wiring 12 and the flow path forming member 4 can be improved without damaging the surfaces of the electrodes 9.

Second Embodiment

A method of manufacturing a liquid ejection head according to a second embodiment of the present invention includes the following steps of: forming a side wall portion of a flow path forming member configured to form a flow path of a liquid and a mold material of the flow path on a substrate having an energy-generating element to be used for ejecting the liquid arranged thereon; forming a conductive adhesive layer on the side wall portion and the mold material; patterning the conductive adhesive layer to form an electrode configured to generate a flow of the liquid and a wiring configured to supply electric power to the electrode; forming a ceiling portion of the flow path forming member having an ejection orifice for ejecting the liquid on the side wall portion, the mold material, the electrode, and the wiring; and removing the mold material to form the flow path. In this case, the side wall portion of the flow path forming member contains an organic material. Further, the conductive adhesive layer contains at least one of conductive DLC or ITO. The side wall portion of the flow path forming member refers to a portion for forming a side wall of the flow path in the flow path forming member.

When the electrode is arranged on the surface of the flow path forming member that is held in contact with the flow path, an interface between the wiring and the flow path forming member is present on two surfaces, that is, a front surface and a rear surface of the wiring, and hence the number of steps is significantly increased when an insulating adhesive layer is inserted into the interface. Meanwhile, in the method according to the second embodiment, the conductive adhesive layer forming the electrode and the wiring can be formed at a time. Therefore, even when the electrode is arranged on the surface of the flow path forming member that is held in contact with the flow path, an increase in number of manufacturing steps can be suppressed. Further, the conductive adhesive layer has high conductivity. Therefore, even when the electrode has a low-resistance layer, and the conductive adhesive layer is formed on the low-resistance layer, it is not required to remove the conductive adhesive layer, and the surface of the electrode is not damaged. Further, the conductive adhesive layer exhibits high adhesiveness with respect to the flow path forming member containing the organic material, and hence high adhesiveness can be ensured at the interface between the wiring and the flow path forming member.

In the method according to the second embodiment, a ceiling portion of the flow path forming member forming a ceiling part of the flow path can contain an organic material. In this case, it is preferred that the above-mentioned method further include: after forming the conductive adhesive layer and before forming the electrode and the wiring, forming, on the conductive adhesive layer, a low-resistance layer having a volume resistivity lower than a volume resistivity of the conductive adhesive layer to be a part of the electrode and the wiring; and forming again the conductive adhesive layer on the conductive adhesive layer and the low-resistance layer. This is because a sufficient voltage can be applied from the wiring to the electrode by forming the low-resistance layer. Now, one example of the second embodiment is described with reference to FIG. 6A to FIG. 6G.

Figure 6A:
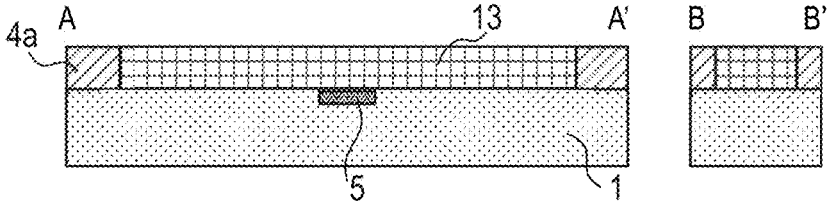
FIG. 6A is a view for illustrating one example of a step of manufacturing an ink jet recording head according another embodiment of the present invention, with the left side being a schematic sectional view of the ink jet recording head taken along the line A-A' of FIG. 2A, and the right side being a schematic sectional view of the ink jet recording head taken along the line B-B' of FIG. 2A.

FIG. 6A to FIG. 6G are each a view for illustrating a step in cross sections of the ink jet recording head taken along the line A-A' and the line B-B' of FIG. 2A. First, as illustrated in FIG. 6A, a side wall portion 4*a* of the flow path forming member and a mold material 13 of the flow path are formed on the substrate 1 having the energy-generating elements 5. The side wall portion 4*a* of the flow path forming member is formed, for example, through use of a negative resist containing an epoxy resin. After that, a positive resist is spin-coated onto the substrate 1 and the side wall portion 4*a* of the flow path forming member and flattened through use of CMP, and thus the mold material 13 can be formed.

Figure 6B:
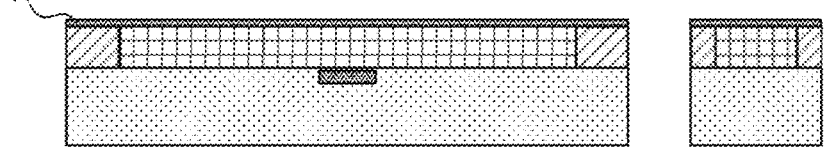
FIG. 6B is a view for illustrating one example of a step of manufacturing an ink jet recording head according to the embodiment of the present invention, with the left side being a schematic sectional view of the ink jet recording head taken along the line A-A' of FIG. 2A, and the right side being a schematic sectional view of the ink jet recording head taken along the line B-B' of FIG. 2A.
Figure 6C:
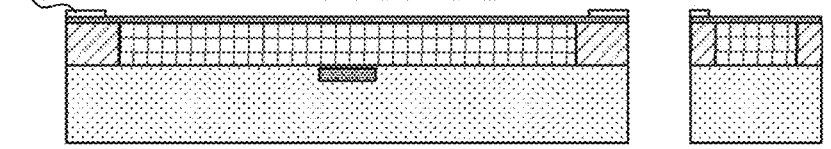
FIG. 6C is a view for illustrating one example of a step of manufacturing an ink jet recording head according to the embodiment of the present invention, with the left side being a schematic sectional view of the ink jet recording head taken along the line A-A' of FIG. 2A, and the right side being a schematic sectional view of the ink jet recording head taken along the line B-B' of FIG. 2A.
Figure 6D:
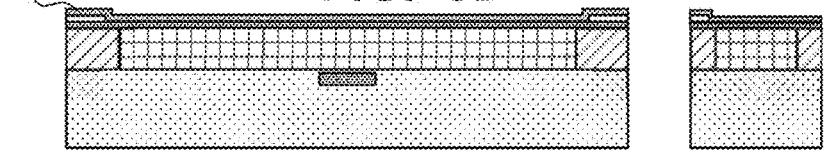
FIG. 6D is a view for illustrating one example of a step of manufacturing an ink jet recording head according to the embodiment of the present invention, with the left side being a schematic sectional view of the ink jet recording head taken along the line A-A' of FIG. 2A, and the right side being a schematic sectional view of the ink jet recording head taken along the line B-B' of FIG. 2A.

Next, as illustrated in FIG. 6B, the conductive adhesive layer 11 is formed on the side wall portion 4*a* of the flow path forming member and the mold material 13. The conductive adhesive layer 11 can be formed in the same manner as in the first embodiment. Next, as illustrated in FIG. 6C, the low-resistance layer 10 having a pattern of the wiring 12 is formed on the conductive adhesive layer 11. The low-resistance layer 10 can be formed in the same manner as in the first embodiment. Next, as illustrated in FIG. 6D, the conductive adhesive layer 11 is formed again on the conductive adhesive layer 11 and the low-resistance layer 10.

Figure 6E:
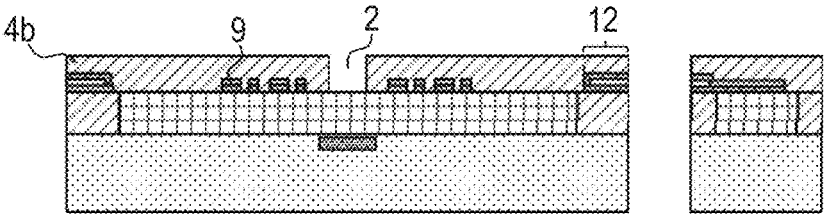
FIG. 6E is a view for illustrating one example of a step of manufacturing an ink jet recording head according to the embodiment of the present invention, with the left side being a schematic sectional view of the ink jet recording head taken along the line A-A' of FIG. 2A, and the right side being a schematic sectional view of the ink jet recording head taken along the line B-B' of FIG. 2A.

Next, as illustrated in FIG. 6E, the conductive adhesive layer 11 is patterned to form the electrodes 9 and the wiring 12, and a ceiling portion 4*b* of the flow path forming member containing the organic material is formed on the side wall portion 4*a* of the flow path forming member, the mold material 13, the electrodes 9, and the wiring 12. The conductive adhesive layer 11 can be patterned in the same way as in the first embodiment. In particular, it is preferred that the conductive adhesive layer 11 contain ITO because processing by wet etching is easy. In this case, even at a time of over-etching, the selection ratio with respect to the mold material 13 is high, and hence a dimensional shape can be maintained. As a material for the ceiling portion 4*b* of the flow path forming member, a negative resist containing an epoxy resin can be used. It is preferred that the ceiling portion 4*b* of the flow path forming member be formed through use of a photolithography technology because the energy-generating element 5 and the ejection orifice 2 can be positioned with satisfactory accuracy.

Figure 6F:
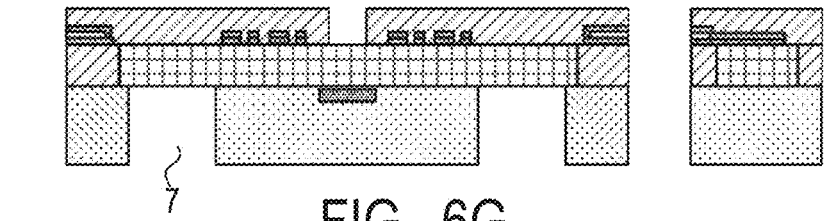
FIG. 6F is a view for illustrating one example of a step of manufacturing an ink jet recording head according to the embodiment of the present invention, with the left side being a schematic sectional view of the ink jet recording head taken along the line A-A' of FIG. 2A, and the right side being a schematic sectional view of the ink jet recording head taken along the line B-B' of FIG. 2A.
Figure 6G:
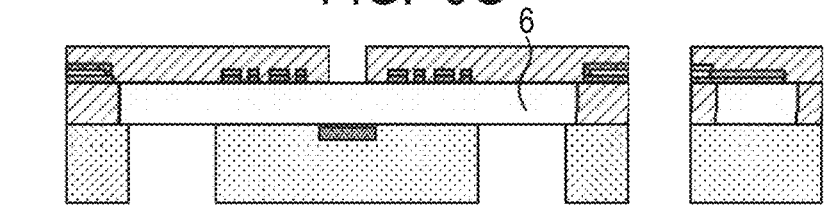
FIG. 6G is a view for illustrating one example of a step of manufacturing an ink jet recording head according to the embodiment of the present invention, with the left side being a schematic sectional view of the ink jet recording head taken along the line A-A' of FIG. 2A, and the right side being a schematic sectional view of the ink jet recording head taken along the line B-B' of FIG. 2A.

Next, as illustrated in FIG. 6F, the supply port 7 is formed in the substrate 1. The supply port 7 can be formed in the same manner as in the first embodiment. Next, as illustrated in FIG. 6G, the mold material 13 is removed to form the flow path 6. The mold material 13 can be removed, for example, by dissolving the mold material 13 with an organic solvent.

In the method illustrated in FIG. 6A to FIG. 6G, the electrodes 9 and the wiring 12 can be formed and processed at a time through use of the same material. Therefore, although the wiring 12 has an interface with respect to the flow path forming member 4 on two surfaces, that is, a front surface and a rear surface, the number of manufacturing steps can be reduced. Further, the adhesiveness between the wiring 12 and the flow path forming member 4 can be improved without damaging the surfaces of the electrodes 9.

Further, in the method according to the second embodiment, the ceiling portion 4*b* of the flow path forming member can contain an inorganic material. In this case, it is preferred that the above-mentioned method further include, after forming the conductive adhesive layer and before forming the electrode and the wiring, forming, on the conductive adhesive layer, a low-resistance layer having a volume resistivity lower than a volume resistivity of the conductive adhesive layer to be a part of the electrode and the wiring. This is because a sufficient voltage can be applied from the wiring to the electrode by forming the low-resistance layer. Now, one example of the second embodiment is described with reference to FIG. 7A and FIG. 7B.

Figure 7A:
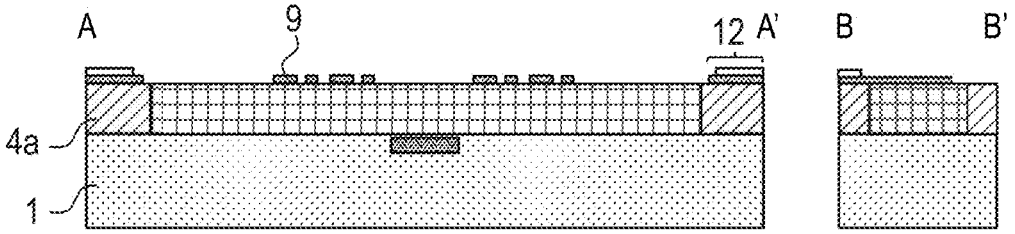
FIG. 7A is a view for illustrating one example of a step of manufacturing the ink jet recording head according to the embodiment of the present invention, with the left side being a schematic sectional view of the ink jet recording head taken along the line A-A' of FIG. 2A, and the right side being a schematic sectional view of the ink jet recording head taken along the line B-B' of FIG. 2A.
Figure 7B:
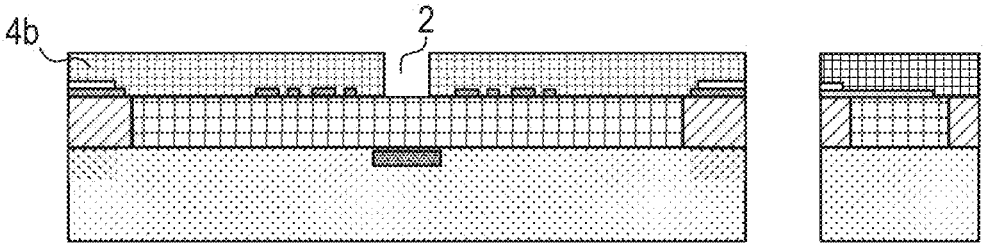
FIG. 7B is a view for illustrating one example of a step of manufacturing the ink jet recording head according to the embodiment of the present invention, with the left side being a schematic sectional view of the ink jet recording head taken along the line A-A' of FIG. 2A, and the right side being a schematic sectional view of the ink jet recording head taken along the line B-B' of FIG. 2A.

FIG. 7A and FIG. 7B are each a view for illustrating a step in cross sections of the ink jet recording head taken along the line A-A' and the line B-B' of FIG. 2A. First, the same steps as those in FIG. 6A to FIG. 6C are performed. Next, as illustrated in FIG. 7A, the conductive adhesive layer 11 is patterned to form the electrodes 9 and the wiring 12. The conductive adhesive layer 11 can be patterned in the same manner as in the first embodiment.

Next, as illustrated in FIG. 7B, a ceiling portion 4*b* of the flow path forming member containing an inorganic material is formed on the side wall portion 4*a* of the flow path forming member, the mold material 13, the electrodes 9, and the wiring 12. As a material for the ceiling portion 4*b* of the flow path forming member, there are given silicon oxide, silicon nitride, and silicon carbide. Those materials may be used alone or in combination of two or more kinds. The ceiling portion 4*b* of the flow path forming member can be formed through use of a general film forming device, for example, CVD. After that, the ejection orifices 2 can be formed through use of a photolithography technology and an etching technology. Then, the same steps as those in FIG. 6F and FIG. 6G are performed.

In the method illustrated in FIG. 7A and FIG. 7B, the ceiling portion 4*b* of the flow path forming member contains an inorganic material, and hence the step of forming again the conductive adhesive layer 11 (FIG. 6D) can be omitted to reduce the number of manufacturing steps as compared to the method illustrated in FIG. 6A to FIG. 6G.

EXAMPLE

Evaluation of Conductivity

Various layers were formed on a silicon wafer with a thermal oxide film, and a thickness and a resistance of each of the layers were measured with a contact type step profiler. A volume resistivity of each of the layers was calculated based on those two measured values.

Evaluation of Adhesiveness

A negative epoxy resin composition was spin-coated onto the silicon wafer with a thermal oxide film having various layers formed thereon manufactured in the evaluation of conductivity. The negative epoxy resin composition was exposed to light having a wavelength of 365 nm, developed, and baked. With this, a semicircular column having a height of 15 μm and a diameter φ of 100 μm, serving as a flow path forming member, was formed. An evaluation sample thus obtained was immersed in two kinds of inks (ink A and ink B) to measure a joint strength (shear strength) between the layer and the flow path forming member before and after immersion in the inks.

Figure 8:
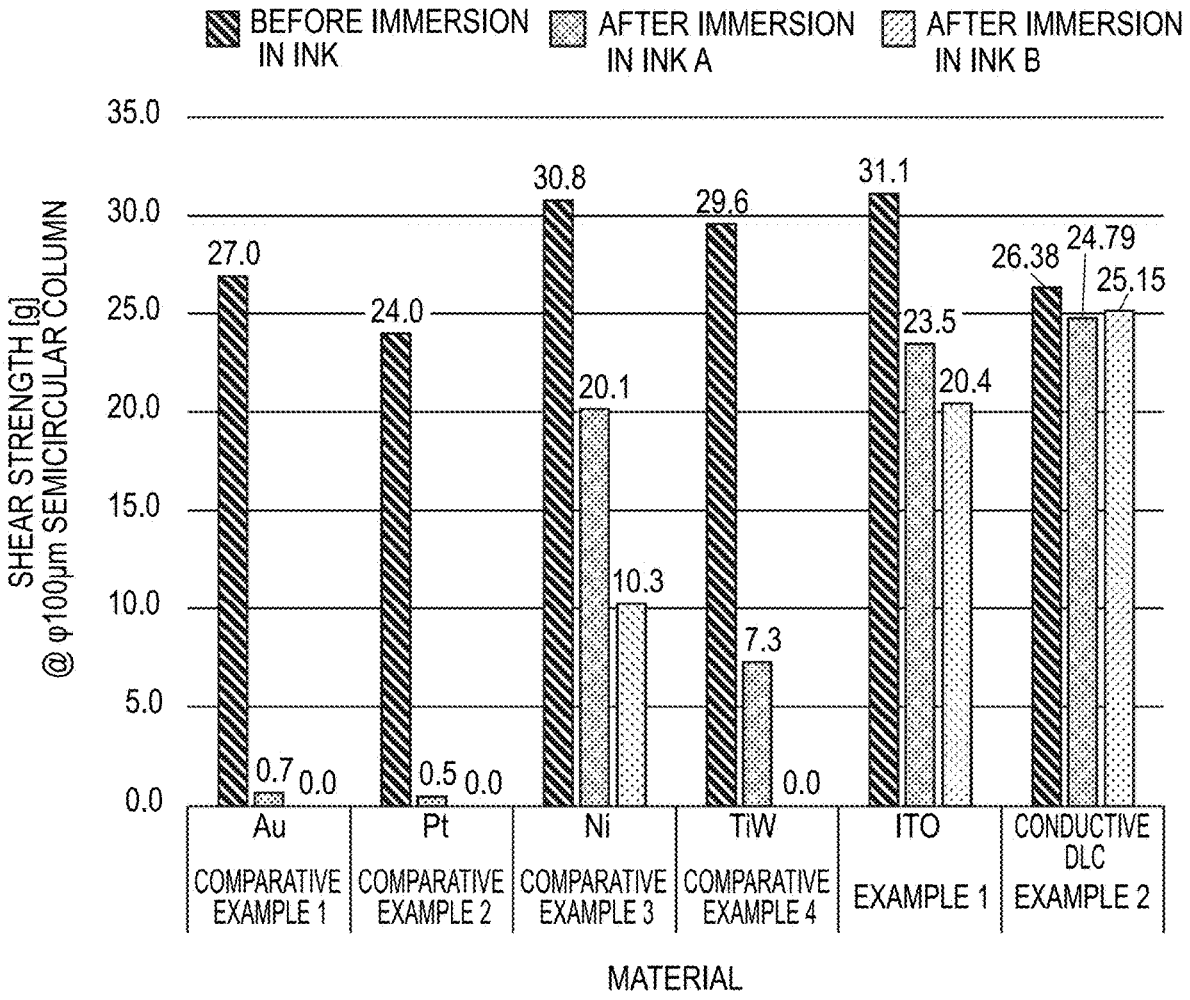
FIG. 8 is a graph for showing measurement results of shear strengths in Examples and Comparative Examples.

A solution obtained by mixing an appropriate amount of an organic solvent (2-pyrolidone, 1,2-hexanediol, polyethylene glycol, and acetylene) with water was used as the ink A. Further, ink sealed in an ink cartridge (product name: PGI-2300BK manufactured by Canon Inc.) was used as the ink B. Immersion into each ink was performed by sealing each ink and the evaluation sample into a pressure kiln to set a jar and performing a pressure cooker test at 120° C. for 10 hours. The semicircular column was measured for a shear strength under the conditions of a height of 1 μm and a scan speed of 6 μm/s. Measurement results of the shear strength are shown together in FIG. 8.

Example 1

ITO was formed as a film having a thickness of 200 nm on a silicon wafer with a thermal oxide film by magnetron sputtering, to thereby form a layer. The layer was evaluated for conductivity to find a volume resistivity of the layer of 1.0×10−3 Ωcm. Evaluation of adhesiveness was performed through use of the silicon wafer with a thermal oxide film having the layer formed thereon. A shear strength average value before immersion in ink was 31.1 g. Meanwhile, the shear strength after immersion in the ink A was 23.5 g, and the shear strength after immersion in the ink B was 20.4 g. In Example 1, there was no significant change in adhesiveness between the layer and the flow path forming member before and after immersion in ink, and a sufficient joint strength was maintained even after immersion in ink.

Example 2

Boron-doped conductive DLC was formed as a film having a thickness of 150 nm by plasma ion implantation and film forming (through use of a device manufactured by Plasma Ion Asist Co., Ltd.) on a silicon wafer with a thermal oxide film, to thereby form a layer. The layer was evaluated for conductivity to find a volume resistivity of the layer of 1.5×10−2 Ωcm. Evaluation of adhesiveness was performed through use of the silicon wafer with a thermal oxide film having the layer formed thereon. A shear strength average value before immersion in ink was 26.4 g. Meanwhile, the shear strength after immersion in the ink A was 24.8 g, and the shear strength after immersion in the ink B was 25.2 g. In Example 2, there was no significant change in adhesiveness between the layer and the flow path forming member before and after immersion in ink, and a sufficient joint strength was maintained even after immersion in ink.

Comparative Example 1

Gold (Au) was formed as a film having a thickness of 200 nm on a silicon wafer with a thermal oxide film by magnetron sputtering, to thereby form a layer. The layer was evaluated for conductivity to find a volume resistivity of the layer of 1.2×105 Ωcm. Evaluation of adhesiveness was performed through use of the silicon wafer with a thermal oxide film having the layer formed thereon. A shear strength average value before immersion in ink was 27.0 g. Meanwhile, the shear strength after immersion in the ink A was 0.7 g, and the shear strength after immersion in the ink B was 0 g (the shear strength was not able to be measured due to peeling).

Comparative Example 2

Platinum (Pt) was formed as a film having a thickness of 100 nm on a silicon wafer with a thermal oxide film by magnetron sputtering, to thereby form a layer. The layer was evaluated for conductivity to find a volume resistivity of the layer of 2.0×10−5 Ωcm. Evaluation of adhesiveness was performed through use of the silicon wafer with a thermal oxide film having the layer formed thereon. A shear strength average value before immersion in ink was 24.0 g. Meanwhile, the shear strength after immersion in the ink A was 0.5 g, and the shear strength after immersion in the ink B was 0 g (the shear strength was not able to be measured due to peeling).

Comparative Example 3

Nickel (Ni) was formed as a film having a thickness of 65 nm on a silicon wafer with a thermal oxide film by magnetron sputtering, to thereby form a layer. The layer was evaluated for conductivity to find a volume resistivity of the layer of 1.4×10−5 Ωcm. Evaluation of adhesiveness was performed through use of the silicon wafer with a thermal oxide film having the layer formed thereon. A shear strength average value before immersion in ink was 30.8 g. Meanwhile, the shear strength after immersion in the ink A was 20.1 g, and the shear strength after immersion in the ink B was 10.3 g.

Comparative Example 4

An alloy of tungsten (W) and titanium (T) (Ti: 10% by mass) was formed as a film having a thickness of 100 nm on a silicon wafer with a thermal oxide film by magnetron sputtering, to thereby form a layer. The layer was evaluated for conductivity to find a volume resistivity of the layer of 1.5×105 Ωcm. Evaluation of adhesiveness was performed through use of the silicon wafer with a thermal oxide film having the layer formed thereon. A shear strength average value before immersion in ink was 29.6 g. Meanwhile, the shear strength after immersion in the ink A was 7.3 g, and the shear strength after immersion in the ink B was 0 g (the shear strength was not able to be measured due to peeling).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-186667, filed Sep. 27, 2017, which is hereby incorporated by reference herein in its entirety.

What is claimed is:

1. A liquid ejection head comprising:

a substrate;

an energy-generating element, which is arranged on the substrate, and is used for ejecting a liquid;

a flow path forming member, which has an ejection orifice for ejecting the liquid, and is configured to form a flow path of the liquid between the flow path forming member and the substrate;

an electrode configured to generate a flow of the liquid; and a wiring, which is arranged so as to be brought into contact with the flow path forming member, and is configured to supply electric power to the electrode, wherein the flow path forming member contains an organic material, and wherein each of the electrode and the wiring comprises a conductive adhesive layer containing at least one of conductive diamond-like carbon or tin-doped indium oxide.

2. The liquid ejection head according to claim 1, wherein the conductive adhesive layer contains the conductive diamond-like carbon, and wherein the conductive adhesive layer has a volume resistivity of 10 Ωcm or less.

3. The liquid ejection head according to claim 2, wherein the conductive adhesive layer has a volume resistivity of 0.1 Ωcm or less.

4. The liquid ejection head according to claim 3, wherein the conductive adhesive layer has a volume resistivity of 0.001 Ωcm or less.

5. The liquid ejection head according to claim 1, wherein the conductive adhesive layer contains the tin-doped indium oxide, and wherein the conductive adhesive layer has a volume resistivity of 0.001 Ωcm or less.

6. The liquid ejection head according to claim 1, wherein at least one of the electrode or the wiring is arranged on the substrate.

7. The liquid ejection head according to claim 1, wherein the electrode is arranged on a surface of the flow path forming member that is held in contact with the flow path.

8. The liquid ejection head according to claim 7, wherein at least a part of the wiring is arranged in the flow path forming member.

9. The liquid ejection head according to claim 1, wherein at least one of the electrode or the wiring further includes a low-resistance layer having a volume resistivity lower than a volume resistivity of the conductive adhesive layer.

10. The liquid ejection head according to claim 1, wherein at least one of the electrode or the wiring is formed of the conductive adhesive layer.

11. The liquid ejection head according to claim 1, wherein the organic material is an epoxy resin.

12. The liquid ejection head according to claim 1, wherein the conductive diamond-like carbon contains at least one element selected from the group consisting of boron, nitrogen, and nickel.

13. The liquid ejection head according to claim 1, wherein the energy-generating element is arranged in a pressure chamber, and wherein the liquid in the pressure chamber is circulated between the pressure chamber and an outside.

14. A method of manufacturing a liquid ejection head, the method comprising:

forming a conductive adhesive layer on a substrate having an energy-generating element to be used for ejecting a liquid arranged thereon;

patterning the conductive adhesive layer and forming an electrode configured to generate a flow of the liquid and a wiring configured to supply electric power to the electrode, each of the electrode and the wiring comprising the conductive adhesive layer; and forming a flow path forming member, which has an ejection orifice for ejecting the liquid and is configured to form a flow path of the liquid between the flow path forming member and the substrate, on the substrate so that the flow path forming member is brought into contact with the wiring, wherein the flow path forming member contains an organic material, and wherein the conductive adhesive layer contains at least one of conductive diamond-like carbon or tin-doped indium oxide.

15. The method according to claim 14, further comprising, before the forming of the conductive adhesive layer, forming, on the substrate, a low-resistance layer having a volume resistivity lower than a volume resistivity of the conductive adhesive layer to be a part of the electrode and the wiring.

* * * * *